US009638474B2

(12) United States Patent
Vännman et al.

(10) Patent No.: US 9,638,474 B2
(45) Date of Patent: May 2, 2017

(54) REINFORCED HEAT EXCHANGER PLATE

(75) Inventors: Erik Vännman, Pixbo (SE); Olivier Noël-Baron, Echirolles (FR)

(73) Assignees: ALFA LAVAL CORPORATE AB, Lund (SE); ALFA LAVAL VICARB, Fontanil Cornillon (FR)

( * ) Notice: Subject to any disclaimer, the term of this patent is extended or adjusted under 35 U.S.C. 154(b) by 1195 days.

(21) Appl. No.: 13/142,896

(22) PCT Filed: Dec. 22, 2009

(86) PCT No.: PCT/EP2009/067815

§ 371 (c)(1),
(2), (4) Date: Sep. 22, 2011

(87) PCT Pub. No.: WO2010/079096

PCT Pub. Date: Jul. 15, 2010

(65) Prior Publication Data

US 2012/0031595 A1 Feb. 9, 2012

(30) Foreign Application Priority Data

Jan. 12, 2009 (EP) ..... 09305023

(51) Int. Cl.
*F28F 3/00* (2006.01)
*F28F 3/08* (2006.01)
(Continued)

(52) U.S. Cl.
CPC ..... *F28F 3/046* (2013.01); *F28D 9/00* (2013.01); *F28D 9/0081* (2013.01); *F28F 3/02* (2013.01);
(Continued)

(58) Field of Classification Search
CPC .... F28F 3/046; F28F 3/04; F28F 3/025; F28F 3/14; F28D 9/00; F28D 9/0081
(Continued)

(56) References Cited

U.S. PATENT DOCUMENTS 2,940,736 A * 6/1960 Odman ..... 165/166
3,498,372 A * 3/1970 Collins et al. ..... 165/166
(Continued)

FOREIGN PATENT DOCUMENTS

CN 1441220 A 9/2003
GB 694039 A 7/1953
(Continued)

OTHER PUBLICATIONS

Translation of Japanese Document JP 07260387 named TRANS-JP 07260387 A.*
(Continued)

*Primary Examiner* — Jianying Atkisson
*Assistant Examiner* — Paul Alvare
(74) *Attorney, Agent, or Firm* — Buchanan Ingersoll & Rooney PC

(57) ABSTRACT

Plate suitable for acting as a bulkhead between two fluids flowing in a plate heat exchanger, the plate having a plurality of corrugations each having a bottom crest line and a top crest line, all or part of the corrugations locally having stiffeners formed by a substantial and local reduction of the height of the top crest line, the stiffeners being arranged in a first group of stiffeners distributed on the plate along at least one first line parallel to a diagonal of the plate, the diagonal being perpendicular to the crest lines of the corrugations, the stiffeners of the first group being alternately arranged on either side of the first line on each consecutive corrugation, wherein the distance measured perpendicularly to the first line between the center of the stiffeners of the first group and the first line is the same for each stiffener of the first group.

11 Claims, 2 Drawing Sheets

(51) Int. Cl.

| | |
|---|---|
| ***F28F 13/12*** | (2006.01) |
| ***F28F 3/04*** | (2006.01) |
| *F28F 3/02* | (2006.01) |
| *F28F 3/14* | (2006.01) |
| *F28D 9/00* | (2006.01) |

(52) U.S. Cl.
CPC ..... *F28F 3/025* (2013.01); *F28F 3/14* (2013.01); *F28F 2225/04* (2013.01)

(58) Field of Classification Search
USPC ..... 165/166, 906, 167, 168
See application file for complete search history.

(56) References Cited

U.S. PATENT DOCUMENTS

| | | | | |
|---|---|---|---|---|
| 3,783,090 | A * | 1/1974 | Andersson | F28F 3/083 165/166 |
| 3,931,854 | A | 1/1976 | Ivakhnenko et al. | |
| 4,099,928 | A | 7/1978 | Norback | |
| 4,423,772 | A | 1/1984 | Dahlgren | |
| 4,605,060 | A * | 8/1986 | Andersson | F28D 9/0037 165/146 |
| 7,104,315 | B2 * | 9/2006 | Blomgren | 165/165 |

FOREIGN PATENT DOCUMENTS

| | | | |
|---|---|---|---|
| GB | 1197933 | A * | 7/1970 |
| JP | 49-85649 | | 8/1974 |
| JP | 5241946 | A | 3/1977 |
| JP | 57-73393 | A | 5/1982 |
| JP | 60-162183 | A | 8/1985 |
| JP | 07-260387 | | 10/1995 |
| JP | 7260386 | A | 10/1995 |
| JP | 07260387 | A * | 10/1995 |
| JP | 7260387 | A | 10/1995 |
| JP | 2005-517891 | | 6/2005 |
| WO | 03/069249 | | 8/2003 |
| WO | WO03069249 | A1 | 8/2003 |

OTHER PUBLICATIONS

English language translation of a First Office Action issued by the Chinese Patent Office on Feb. 20, 2013, in the corresponding Chinese Patent Application No. 200980154696.0 (8 pages).

English language translation of a Search Report issued by the Chinese Patent Office on Feb. 6, 2013, in the corresponding Chinese Patent Application No. 200980154696.0 (3pages).

Office Action for Japanese Patent Application 2011-544833 dated Nov. 13, 2012.

English Translation of the First Office Action dated Jul. 29, 2014, issued by the Japan Patent Office in corresponding Japanese Application No. 2011-544833. (3 pgs).

Form PCT/IPEA/416 for Application No. PCT/EP2009/067815, 6 pages.

* cited by examiner

REINFORCED HEAT EXCHANGER PLATE

TECHNICAL FIELD

The invention relates to the field of plates used in plate heat exchangers. Such plates are formed by means of a plate deformed by a press in order to produce a plurality of corrugations on its surface. These plates are then superimposed in order to make a bottom crest line of a first plate corresponding with the top crest lines of several corrugations located on a second plate arranged below the first.

The invention relates more particularly to an improvement of the plate allowing its fabrication with a particular arrangement and orientation of the corrugations on its surface.

PRIOR ART

In general, it is known to modify the form of the corrugations of a plate in order to limit the deformation of the plate during its fabrication. In fact, when a method is implemented to deform a plate in order to produce a plurality of corrugations on its surface, the said surface may be deformed in one or more directions. In this case, a plate is obtained whereof the active heat exchange zone does not have perpendicular adjacent sides.

To avoid these undesirable deformations or a local elongation of the plate, it is therefore known to add stiffeners which consist of a substantial reduction of the height of the top crest line or even a complete flattening of the corrugation. However, this type of stiffener is generally distributed for the whole surface of the plate in order to improve the stiffness of a plate in the direction perpendicular to the corrugations.

Thus, it is the object of the invention to provide an advantageous distribution of the stiffeners on the surface of the plate in order to improve the reinforcement of the plate in the direction perpendicular to the corrugations and to uniform the stiffness of a plate in both directions.

It is a further object of the invention to avoid locally disturbing the circulation of the fluid between the two plates despite the presence of stiffeners.

SUMMARY OF THE INVENTION

The invention therefore relates to a plate suitable for acting as a bulkhead between two fluids flowing in a plate heat exchanger. Such a plate comprises a plurality of corrugations each having a bottom crest line and a top crest line. All or part of the corrugations of the plate locally comprise stiffeners formed by a substantial or even total and local reduction of the height of the top crest line. The stiffeners are arranged in a first group of stiffeners distributed on the plate along at least one first line parallel to a diagonal of the plate, the diagonal being perpendicular to the crest lines of the corrugations. The stiffeners of the first group are alternately arranged on either side of the first line on each consecutive corrugation.

The invention is characterized in that the distance measured perpendicularly to the first line between the centre of the stiffeners of the first group and the first line is the same for each stiffener.

In other words, the stiffeners of the first group are distributed along the first line of the plate which perpendicular to the crest lines of the corrugations, serving to limit the elongation of the plate in a direction normal to the corrugations. On this first line, the stiffeners are also alternately positioned on each consecutive corrugation on one side or the other. Thus, the stiffeners are not distributed on the whole surface of the plate, but are located at least at one line of the plate which is parallel to one diagonal.

The constant distance between the centre of each stiffener of the first group and the first line serves to augment a stiffening effect and to concentrate it in one direction perpendicular to the crests lines of the corrugations.

Advantageously, this distance may be equal to a half-pitch of a corrugation. Indeed, the shortest the distance is, the highest the stiffening effect is.

In practice, the first line may be arranged on the diagonal of the plate which is perpendicular to the crest lines of the corrugations. Thus, the stiffeners of the first group are distributed on the plate along at least this diagonal and alternately positioned on each consecutive corrugation.

According to a particular embodiment, the stiffeners may also be arranged in a second group of stiffeners distributed on the plate along a second line parallel to the crest lines of the corrugations, the stiffeners of the second group being alternately arranged on either side of this second line on each consecutive corrugation, the distance measured perpendicularly to the second line between the centre of the stiffeners of the second group and the second line being the same for each stiffeners. The stiffeners distributed along the second line of the plate parallel to the crest lines of the corrugations serve to avoid locally disturbing the fluid flow between the two plates.

Advantageously, the second line may be arranged symmetrically about the first line by a 90 degrees rotation about the centre of the plate. In this way, the elongation of the plate in the direction normal to the corrugations is limited, while not disturbing the fluid circulation, and despite the presence of the stiffeners.

In practice, the stiffeners may have a zero height above the bottom crest line. In this way, stiffeners may be formed by a flat, straight strip or simply a crest line connecting two bottom crest lines of the plate in this case.

Furthermore, other groups of stiffeners may be used and distributed along lines which may be arranged parallel or perpendicular to the first and second lines comprising the first groups of stiffeners.

Thus, the plate may comprise at least one third group of stiffeners alternately arranged on either side of a third line parallel to the first line.

In consequence, such an embodiment serves to augment a stiffening of the plate in the direction normal to the corrugations, and on the whole surface of the plate.

Furthermore, the plate may comprise another third group of stiffeners arranged on either side of a fourth line and symmetrically about the third preceding group by a 90 degrees rotation about the centre of the plate.

Such a rotational symmetry may be effected in both rotation directions and serves to avoid locally disturbing fluid circulation between the two plates.

In practice, the distances between adjacent parallel lines of stiffeners may be the same for each line. Furthermore, the distance between two stiffeners on the same crest line is preferably constant and at least equal to one corrugation pitch. Thus, the stiffness of the plate is increased in a uniform manner in the direction perpendicular to the corrugations.

BRIEF DESCRIPTION OF THE FIGURES

The manner of implementing the invention and the advantages thereof will clearly appear from the embodiment that follows, provided for information, but non-limiting, in conjunction with the figures in which.

MANNER OF IMPLEMENTING THE INVENTION

As already stated, the invention relates to a plate acting as a bulkhead between two fluids flowing in a plate heat exchanger.

Figure 1:
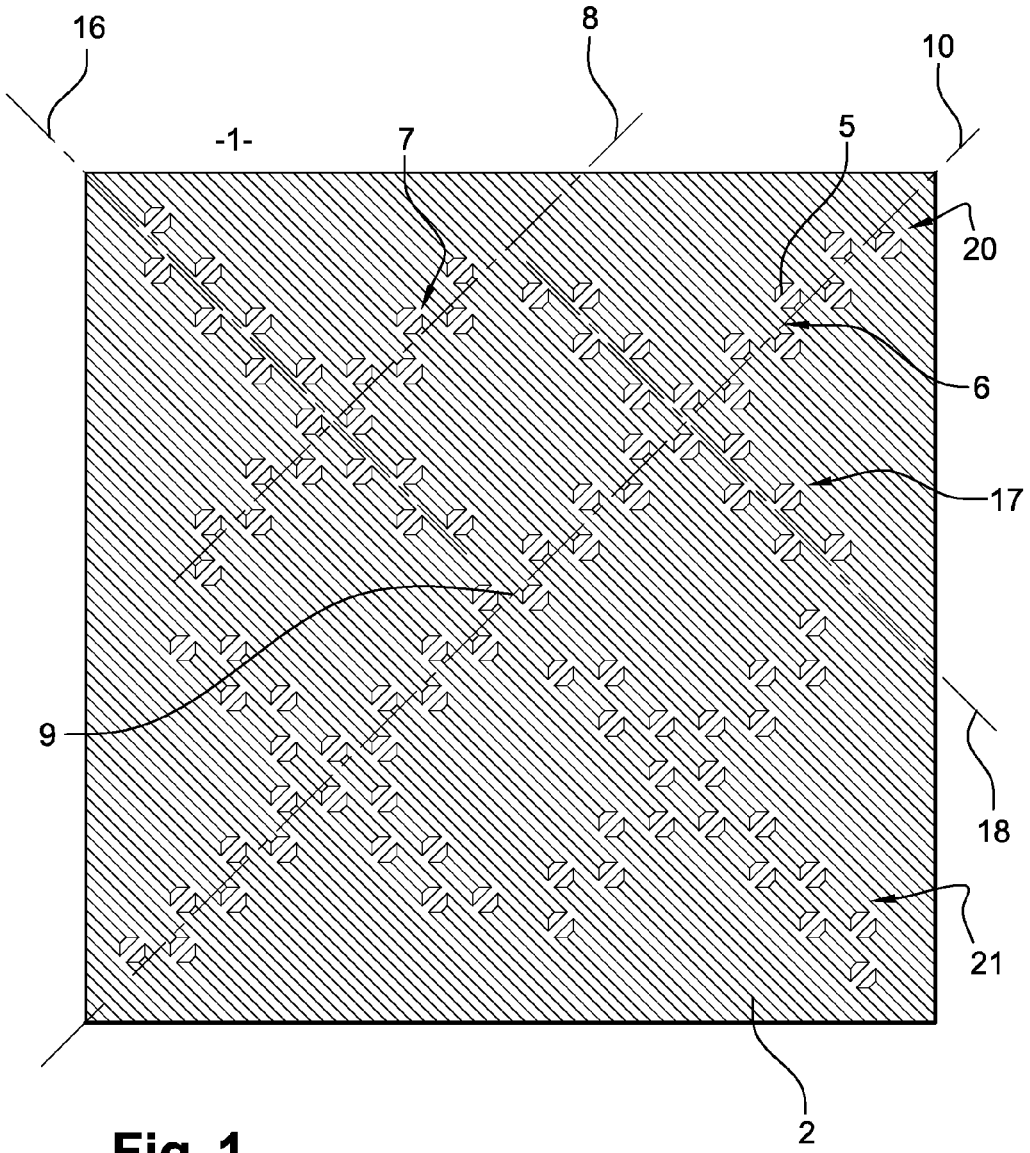
FIG. 1 is a front view of a plate according to the invention.

As shown in FIG. 1, such a plate 1 has a plurality of corrugations 2 on which stiffeners 5 are arranged, formed by a substantial or even total and local reduction of the height of these corrugations 2.

According to the invention, these stiffeners 5 are arranged in a first group 20 distributed on the plate 1 along the first line 6 normal to the corrugations in order to limit the elongation of the plate in this direction during its fabrication. They may also be arranged in a second group 21 distributed along the second line 16 in order to avoid locally disturbing the fluid circulation between the two plates. According to this particular embodiment, the first line 6 is arranged on the diagonal 10 of the plate 1.

Other stiffeners may also be positioned on third line 8 parallel to the first line 6. Those stiffeners are arranged in this case according to a third group 7 of stiffeners on either side of the third line 8.

Furthermore, another third group 17 of stiffeners may be arranged along a fourth line 18 perpendicular to the first line 6 and to the second line 8, the stiffeners of this other third group 17 also being arranged on either side of the fourth line 18. Thus, the other third group 17 is the symmetrical counterpart of the third group 7 by rotation about the centre 9 of the plate 1.

As shown, the plate 1 is formed by a grid of stiffeners 5 arranged in first group 20, second group 21, third group 7 and other third group 17 distributed along a first and second lines 6, 16 and plurality of third and fourth lines 8, 18.

Figure 2:
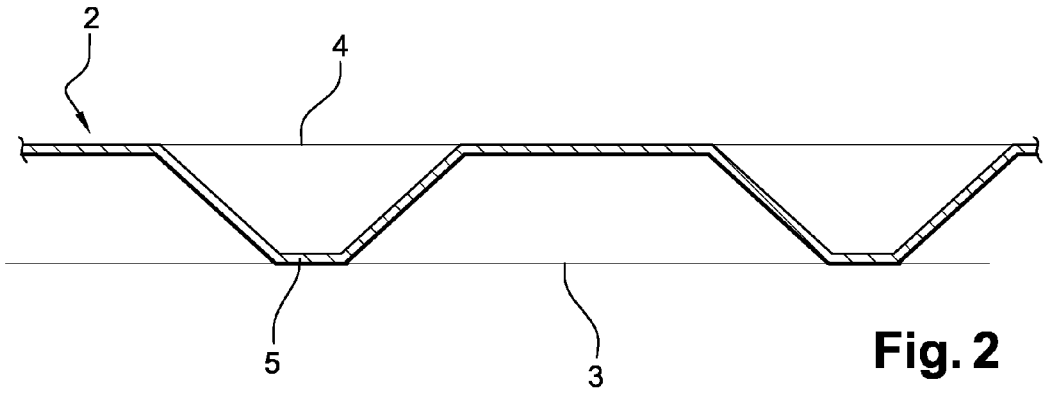
FIG. 2 shows a cross section of a plate in a plane parallel to the corrugations.

As shown in FIG. 2, each corrugation 2 has a bottom crest line 3 and a top crest line 4. The cross section is shown here at the top crest line 4 in a plane parallel to the corrugation 2. Thus, the stiffener 5 consists of a local reduction of the height of the crest line 4 of the corrugation 2.

Figure 3:
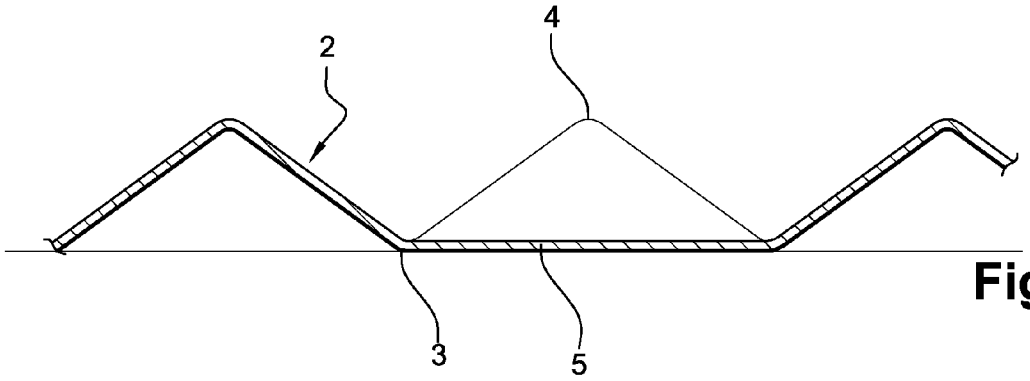
FIGS. 3 and 4 show, along a section in a plane perpendicular to the corrugations, two alternative stiffeners, according to the invention.
Figure 4:
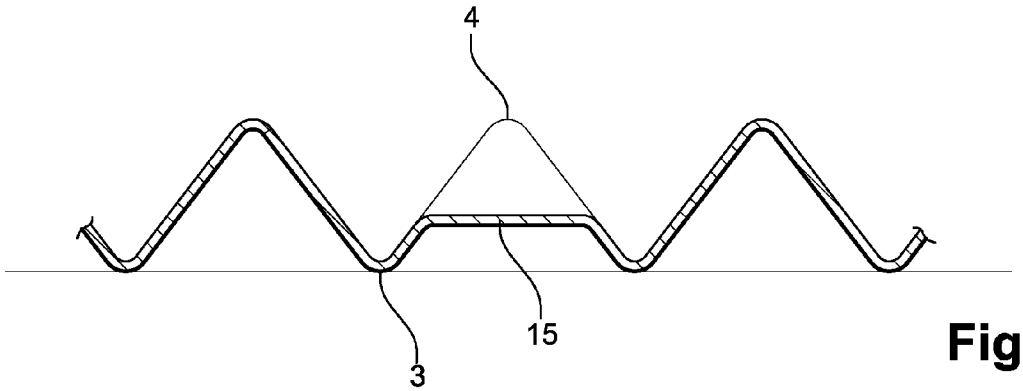

As shown in FIGS. 3 and 4, in a plane perpendicular to the corrugations 2, the height of the stiffeners 5 and 15 may vary according to the type of plate or its dimensions.

As shown in FIG. 3, the stiffener 5 has a zero height above the bottom crest line 3.

According to another embodiment and as shown in FIG. 4, the stiffener 15 may have a height of which the value is between 0 and a half-height of corrugation.

It appears from the above that a plate according to the invention has numerous advantages and in particular:

it serves to limit the elongation deformations during its fabrication;

it does not disturb the fluid circulation inside the heat exchanger.

What is claimed is:

1. A plate suitable for acting as a bulkhead between two fluids flowing in a plate heat exchanger, the plate possessing edges meeting at two corners and a diagonal joining the two corners, the plate possessing an outer periphery and comprising:

a plurality of corrugations each having a bottom crest line and a top crest line, all of the bottom crest lines and all of the top crest lines of the plate being parallel to one another;

at least some of the corrugations of the plate locally comprising stiffeners formed by a local reduction of the height of the top crest line from a first height of the top crest line;

the stiffeners being arranged in a first group of stiffeners distributed on the plate along at least one first line parallel to the diagonal of the plate, the diagonal being perpendicular to the crest lines of the corrugations;

the stiffeners of the first group being alternately arranged on either side of the first line on each consecutive corrugation;

the distance measured perpendicularly to the first line from the center of the stiffeners of the first group to the first line being the same for each stiffener of the first group; and each of the corrugations that includes a stiffener arranged on one side of the first line at the perpendicular distance from the first line possessing a height equal to the first height on the other side of the first line at the perpendicular distance from the first line.

2. The plate according to claim 1, wherein the distance between the center of each stiffener of the first group and the first line is equal to half a pitch of the corrugations.

3. The plate according to claim 1, wherein the first line is arranged on the diagonal.

4. The plate according to claim 1, wherein the stiffeners are arranged in a second group of stiffeners distributed on the plate along a second line parallel to the crest lines of the corrugations, the stiffeners of the second group being alternately arranged on either side of the second line on each consecutive corrugation, the distance measured perpendicularly to the second line between the center of the stiffeners of the second group and the second line being the same for each stiffener of the second group.

5. The plate according to claim 4, wherein the second line is arranged symmetrically about the first line by a 90 degrees rotation about the center of the plate.

6. The plate according to claim 1, wherein the stiffeners have a zero height above the bottom crest line.

7. The plate according to claim 1, further comprising at least one third group of stiffeners alternately arranged on either side of a third line parallel to the first line.

8. The plate according to claim 7, further comprising a fourth group of stiffeners arranged on either side of a fourth line and symmetrically about the third group by a 90 degrees rotation about the center of the plate.

9. The plate according to claim 7, wherein distances measured perpendicularly between adjacent parallel lines of stiffeners are the same for each line.

10. The plate according to claim 8, wherein distances measured perpendicularly between adjacent parallel lines of stiffeners are the same for each line.

11. The plate according to claim 1, wherein the corrugations include corrugations of varying lengths.

* * * * *